US005079536A

United States Patent [19]

Chapman

[11] Patent Number: 5,079,536

[45] Date of Patent: Jan. 7, 1992

[54] PRESSURE TRANSDUCER FOR MUSICAL INSTRUMENT CONTROL

[76] Inventor: Emmett H. Chapman, 6011 Woodlake Ave., Woodland Hills, Calif. 91367-3238

[21] Appl. No.: 487,859

[22] Filed: Mar. 5, 1990

[51] Int. Cl.[5] ..... H01C 10/10

[52] U.S. Cl. ..... 338/99; 338/69; 338/71; 338/112; 338/153; 84/690

[58] Field of Search ..... 338/99, 69, 71, 108, 338/112, 153; 84/746, 721, 670, 644, 626, 658, 690

[56] References Cited

U.S. PATENT DOCUMENTS

| | | | |
|---|---|---|---|
| 3,624,584 | 11/1971 | Ohno | 338/69 |
| 4,079,651 | 3/1978 | Matsui | 338/69 |
| 4,210,895 | 7/1980 | Sado et al. | 338/99 |
| 4,301,337 | 11/1981 | Eventoff | 84/746 |
| 4,639,710 | 1/1987 | McMillan et al. | 338/108 |
| 4,755,574 | 10/1988 | Fukushima et al. | 84/746 |

*Primary Examiner*—Marvin M. Lateef
*Attorney, Agent, or Firm*—J. E. McTaggart

[57] ABSTRACT

A pressure-to-conductance transducer, which avoids dependency on pressure-sensitive properties of particulate materials which may be difficult to formulate in stable form, utilizes instead the principle of translating applied pressure into variation of area and region of contact between a resistively coated Mylar tape element and a pair of adjacent contact plates, connected to controlled circuitry via a cable. In an embodiment for foot control of musical effects, a base mounts the contact plates and a surrounding separable Velcro gasket supporting a semi-rigid pressure sensor plate holding the resistive element closely spaced above the contact plates. A void in the element spans the gap between the contact plates. The conductance value appearing between the contact plates varies with the pressure applied to the sensor plate, ranging from low conductance with light offset pressure to high conductance with heavy overall pressure. Easy internal access and inexpensive materials, particularly the resistive element which may be made from two inch audio recording tape, greatly facilitate maintenance and replacement, and enable easy response tailoring by shaping the resistive element void.

20 Claims, 3 Drawing Sheets

PRESSURE TRANSDUCER FOR MUSICAL INSTRUMENT CONTROL

FIELD OF THE INVENTION

The present invention pertains generally to mechanical-to-electrical transducers, and more particularly to an improved pressure-to-conductance transducer construction responsive to variations in pressure applied by a human operator to provide corresponding conductance variations, i.e. inverse resistance variations, which are typically utilized to exert control through voltage controlled electronic circuitry, for example in foot control of electronic musical effects associated with electronic musical instruments such as amplified guitars, keyboards and the like.

BACKGROUND OF THE INVENTION

Foot operated controls for musical instruments and the like have been configured in various well known mechanical forms; for example, a basic approach utilizes a conventional rotary potentiometer operated by a rocker foot pedal driving the potentiomenter via a rack and pinion gear mechanism.

In some versions of such a basic approach, the audio channel to be controlled was routed directly through the potentiometer; however with advanced electronic technology it has become customary to equip the foot control with only a variable resistance, biased by d.c. to develop a variable voltage which is applied to a voltage controlled amplifier or attenuator in a controller unit.

Generally, conventional rotary rheostats and rocker pedals are subject to deterioration and failures of mechanical moving parts and wiping contact surfaces with time and usage. Also the rocker mechanism ordinarily requires that the pedal be located well above the floor level, resulting in inconvenience and discomfort to the user.

Efforts to overcome the aforementioned drawbacks have led to layered structures in which conventional mechanical moving parts have been eliminated; in one known approach, pressure is applied to a pressure sensitive resistive element via a resilient cover. Such structures normally depend on pressure sensitivity properties of particulate materials, as exemplified in U.S. Pat. No. 4,314,227 to Eventoff.

Generally, in transducers which depend on the pressure sensitive properties of particulate resistive composition materials, considerable difficulty has been experienced in seeking to formulate these materials in sufficiently stable form: repeated compression and relaxation of the material tends to alter its resilience, resistance and/or pressure sensitivity and thus degrade the transducer's performance with time and usage.

Systems of the type addressed by this invention often require a somewhat customized overall input-to-output control response characteristic curve, covering a sufficient dynamic range, to satisfy human and/or equipment factors. Since the overall pressure-to-attribute response curve results from the combination of the transducer's pressure-to-voltage response curve (with constant current) and the electronic circuit's voltage-to-attribute response curve, either or both of these may be modified in attempting to satisfy the overall requirements.

A predominant class of transducers of known art are designed and configured exclusively for mass production, where initial development is hampered by considerable investments in artwork and tooling, and manufacturing demands complex and expensive mass processes such as photo-etching. Thus a particular design and response curve tend to become "frozen", leaving little or no capability in the rigid end product for customization or, in many instances, even for basic service maintenance such as replacement of the resistive element. Such drawbacks are further compounded when unstable resistive materials degrade performance over time and with usage: in the absence of serviceability the only remedy available is to scrap the entire transducer unit and purchase a new one.

While electronic circuit techniques are known for customizing voltage control response to complement a particular transducer configuration, this invention is directed to providing customizing capability in the transducer to avoid or at least minimize necessity of altering pre-existing response setups in the electronic voltage controlled circuitry; accordingly the invention provides, in a novel transducer configuration, the capability of "tailoring" the transducer response characteristic with unprecedented ease and flexibility, under both laboratory and field conditions, to optimize the overall control response characteristic.

OBJECTS OF THE INVENTION

A primary object of the present invention is to provide a novel pressure-to-conductance transducer configuration which allows convenient modification and optimization of the transducer response characteristic.

It is a further object to provide such a readily customized transducer in a low profile configuration adapted for foot control of volume and/or other performance attributes of electronic musical instruments such as amplified guitars.

It is a further object of the present invention to provide such a transducer in a configuration which operates on the principle of varying the region of contact on a simple resistive coating rather than depending on the pressure sensitivity properties of composite particulate resistive materials.

It is still a further object of the present invention to configure the transducer such that it may be manufactured easily and economically, from readily available materials, particularly the resistive element.

A still further object is that the interior of transducer enclosure be made readily accessible for inspection, maintenance, service and modification and that the resistive element be made readily replaceable.

The present invention accomplishes these objects in a novel configuration utilizing as a key element, in cooperation with a pair of adjacent contact plates, a plain small sheet of flexible resistively coated Mylar plastic film, available in inexpensive tape form and requiring no pressure sensitive properties in the resistive material. A cutaway sector of the resistive element may be readily shaped to achieve a desired response characteristic.

BRIEF DESCRIPTION OF THE DRAWINGS

The manner of operation in achieving these and other objects and advantages will be understood through a study of the following descriptions with reference to related drawings, in which.

DETAILED DESCRIPTION

Figure 1:
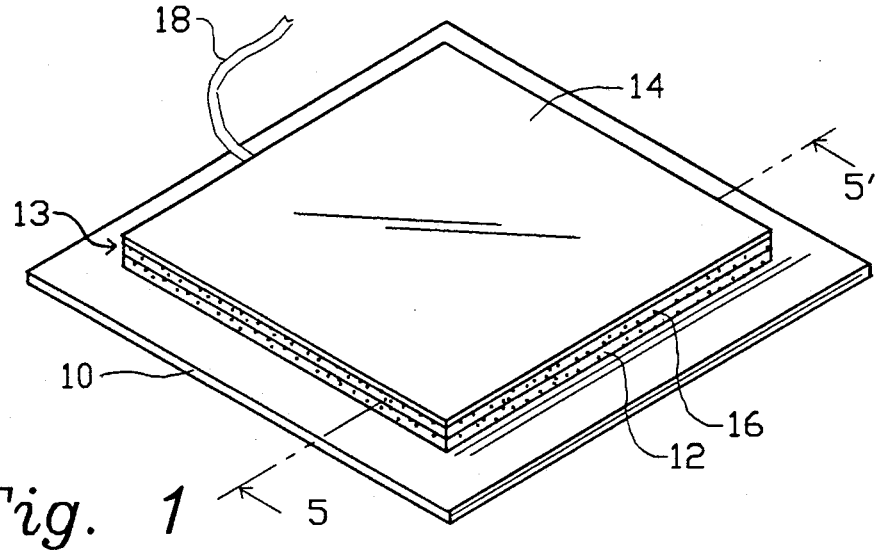
FIG. 1 is perspective view of a pressure-to-conductance transducer in a preferred embodiment of the present invention.

In FIG. 1, a perspective view of a pressure transducer illustrative of the present invention in a preferred embodiment, a horizontal square rigid base plate 10 has a resilient gasket member 12 adhesively fastened onto its upper surface. In a cover cap assembly 13 comprising a semi-rigid sensor plate 14 has adhesively attached around its underside a gasket member 16, matedly engaged with gasket member 12 by a separable fastening system such as the Velcro hook and loop type, the mated gasket pair supporting sensor plate 14 resiliently spaced apart from base plate 10. A cable 18, passes through gasket member 12 at a rear location.

Figure 2:
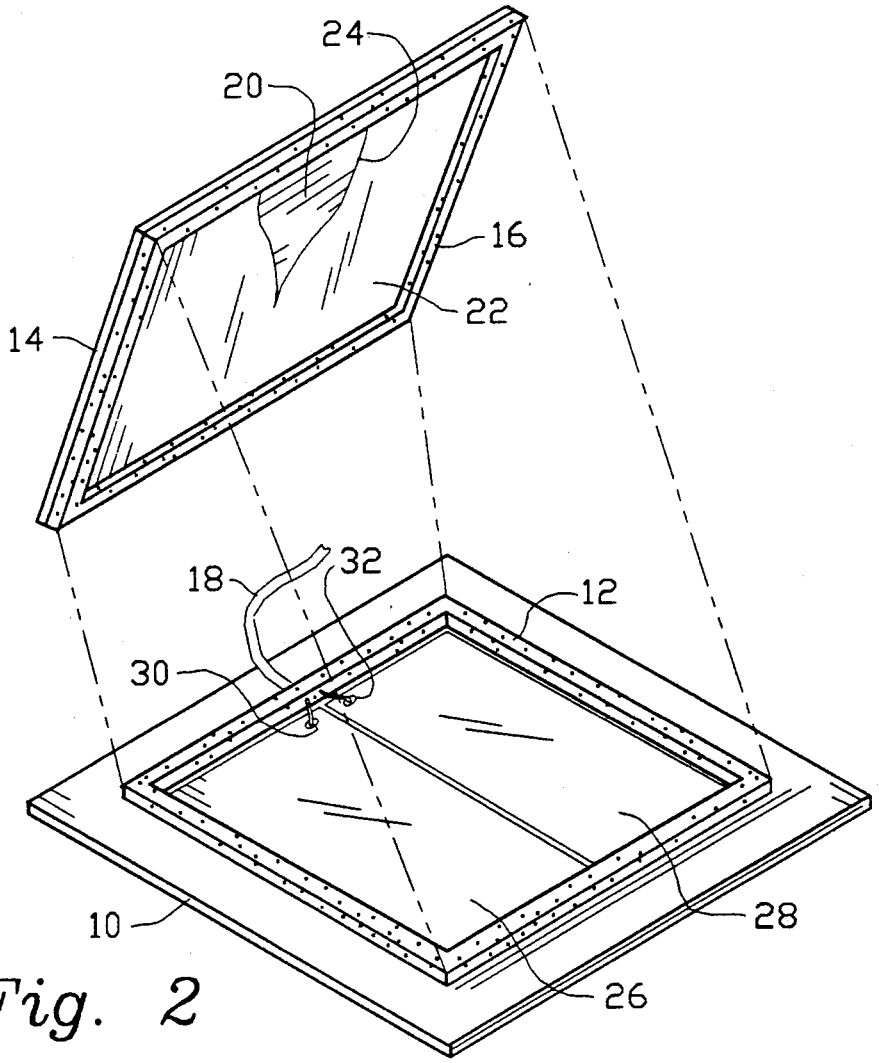
FIG. 2 shows the transducer of FIG. 1 with its two major portions separated to show interior details.

FIG. 2 shows the transducer of FIG. 1 dissembled into two major portions by separating the mating gaskets members 12 and 16 to show internal details. In the upper portion, on the underside of sensor plate 14 covering the area surrounded by gasket member 16 is a resilient layer 20, provided with double sided adhesive which attaches its upper surface to the lower surface of plate 14, and attaches on its underside a resistively coated element 22, having generally the same square outline as layer 20, but having a cutaway sector with a specially shaped boundary 24, extending from a vertex near the center of the element 22 to a central portion of the near edge, i.e. the edge intended to face a person operating the transducer. A portion of resilient layer 20 is seen exposed within the cutaway sector.

In the lower portion, within the area enclosed by gasket 12, on base 10, a pair of elongated rectangular metallic contact plates 26 and 28 are adhesively attached to base 10, located side-by-side separated by a small gap and insulated from each other (and from base 10 if it is conductive). Plates 26 and 28 are each connected to a corresponding conductor of cable 18 at junctions 30 and 32 respectively.

With gaskets 12 and 16 engaged (as in FIG. 1) their combined thickness is sufficient hold element 22 spaced a small distance above contact plates 26 and 28 in the absence of pressure on sensor plate 14; thus, since contact plates 26 and 28 are insulated from each other, the resistance between terminals 30 and 32, and thus between the active conductors of cable 18, will normally be infinitely high, i.e. an open circuit.

Figure 3:
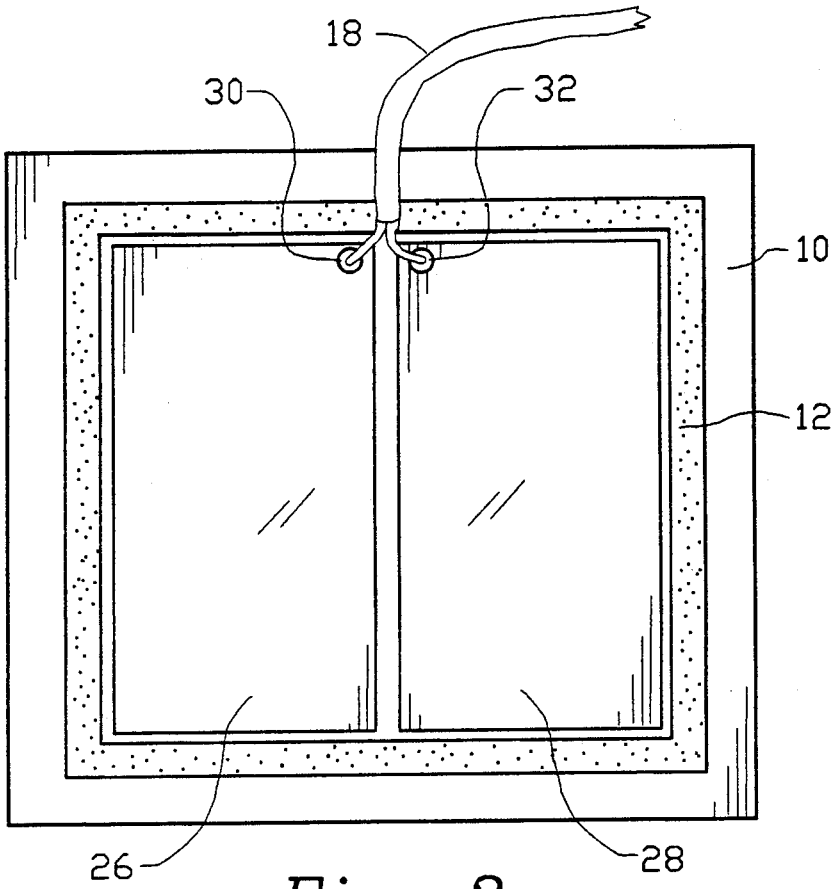
FIG. 3 is a plan view of the lower portion of the transducer of FIG. 1 and 2.

The elements of the lower portion of FIG. 2 are shown in plan view in FIG. 3, which shows that the contact plates 26 and 28 are rectangular, located side-by-side separated by an elongated gap, each covering substantially half of the total square area enclosed by gasket member 12.

Figure 4:
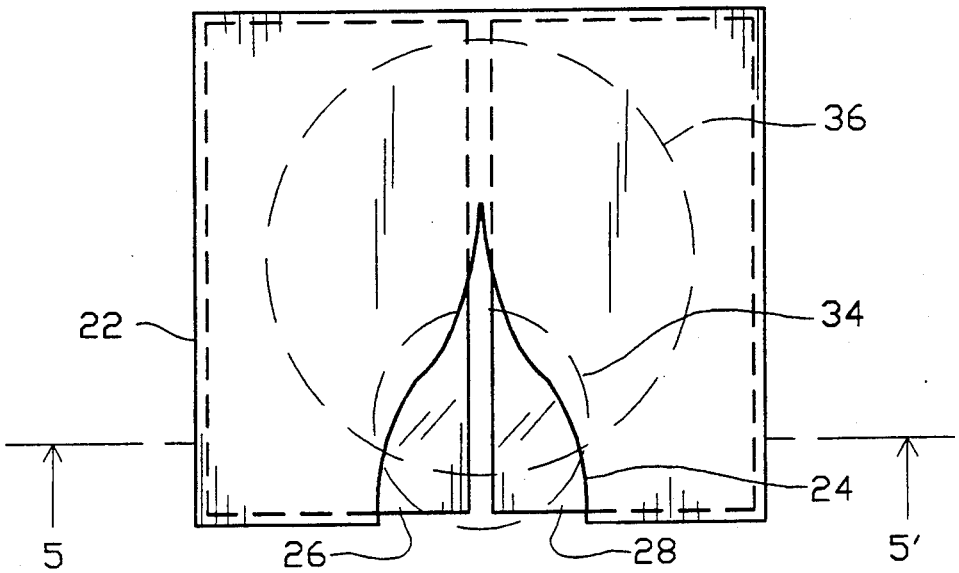
FIG. 4 is a plan view of the resistive element shown in FIG. 2 overlaying the contact plates shown in FIG. 2 and FIG. 3.

In FIG. 4, a plan view shows resistive element 22 overlaying contact plates 26 and 28 of which hidden portions are indicated by dashed lines and corner portions are seen within the boundary 24 of the cutaway sector of element 22.

Figure 5:
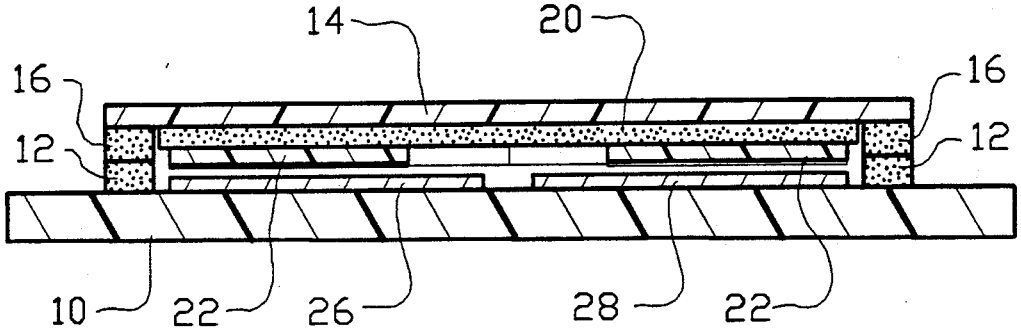
FIG. 5 is cross section taken through axis 5—5' in FIG. 1, including a cross section of the element and plates of FIG. 4 taken through axis 5—5'.

FIG. 5 is a cross section showing the external parts at axis 5—5' of FIG. 1, including base 10, engaged gasket members 12 and 16 and sensor plate 14, and showing the internal parts at axis 5—5' of FIG. 4, including contact plates 26 and 28 affixed to the upward surface of base 10. Disposed closely above the contact plates 26 and 28 is the downward resistively coated surface of resistive element 22 while its upward surface is adhesively affixed to the downward surface of resilient layer 20 whose upward surface is adhesively affixed to the downward surface of sensor plate 14.

It is common to specify the resistivity of a uniform resistive sheet or coating, such as the coating on element 22, as the resistance measured between two opposite sides of a square shaped resistive path, since this will be a constant, independent of the size of the square. Furthermore, it should be intuitively apparent that if the dimensions of the path are changed to form a non-square rectangle, the resistance will be proportional to the aspect ratio, i.e. length/width of the rectangle; thus, compared to a square path, a long narrow path will have a higher resistance, and a short wide path will be have a lower resistance. In the practice of the present invention, while the varying shape of the resistive path is somewhat complex, it can be approximated for qualitative analysis with reference to FIG. 4 between two extremes of operation indicated by the two circular areas of contact 34 and 36, as follows.

To operate the transducer, the operator places the forward part of one foot over the transducer and, keeping the heel on the floor, applies a variable pressure with the ball of the foot being located generally in the region of the edge of the transducer nearest the operator.

When relatively light foot pressure is applied via sensor plate 14, FIGS. 1 and 2, tending to localize the pressure from the ball of the foot onto the edge of the transducer nearest the operator, a combination of bending of sensor plate 14 and compression of gasket members 12 and 16, places element 22, in contact with plates 26 and 28 within the general region indicated in FIG. 4 by the small dashed circle 34. This creates a resistive path, through element 22, which will appear between terminals 30 and 32 as a relatively high resistance due to the high length/width ratio of the shape of the effective resistive path which roughly approximates an inverted U.

When a greater amount of downward pressure is applied to sensor plate 14, FIG. 1, generally shifting the area of pressure from the operator's foot further onto a central region of sensor plate 14, the area of contact increases to that indicated in FIG. 4 by the larger dashed circle 36, where the resistive path through element 22 becomes much shorter and wider, thus a very low resistance value will appear across terminals 30 and 32 (FIG. 3).

It should now be apparent that the resistance may be readily varied continuously over a total range by varying the foot pressure in the manner described, spreading the area of contact and shifting it toward the center of the resistive element as pressure is increased.

The actual response curve of resistance as a function of pressure will depend on the shape of boundary 24 of the cutaway sector of element 22, such that "tailoring" of the response curve shape may be readily accomplished by shaping boundary 24 with a sharp knife. The ready and inexpensive availability of the resistive element 22 in the form of 2 inch wide audio tape makes it feasible to experiment in a "cut-and-try" manner, the removable Velcro type fastenings of gaskets 12 and 16 allowing easy access as seen in FIG. 2, and the element 22 being easily detached from the resilient layer 20, which is also inexpensive and easily replaced if necessary.

Unlike pressure-to-conductance transducers of known art whose principle of operation is based on the properties of pressure-sensitive particulate resistive materials, the transducer of this invention has no such dependency: instead it operates on the principle of varying the resistance by changing both the area and the region of contact of the two conductive contact plates against the surface of the uniformly resistive element in a manner to vary the effective length/width ratio of the area of active resistance in the principal current path. Thus the transducer of this invention in not subject to deterioration of performance due to changes in pressure-sensitivity properties as the resistive material ages.

In the typical practice of a transducer made in accordance with this invention, cable 18 is connected to electrical control circuitry adapted to convert the transducer resistance value found across the active conductors of cable 18 into some desired performance parameter. Usually the varying resistance is converted to a varying voltage by passing a fixed current through the resistance element, and the varying voltage is applied as a control voltage to a voltage controlled electronic circuit or device. As an example, when the transducer is utilized as a foot operated volume control in an electronic musical instrument, a musician applies a varying foot pressure onto the transducer; the resultant varying control voltage is applied to a voltage controlled attenuator which in turn varies the gain of an audio amplifier, thus controlling the volume of sound produced.

Other musical attributes may be controlled from one or more transducers, for example: frequency response (timbre) via voltage controlled filters, cross fading between two sources, reverberation or any number of other special effects in a musical performance.

Beyond the musical field, the transducer of this invention is also readily applicable to other fields where pressure from a human operator is to be transduced and utilized, typically in a voltage control mode, for controlling device such as a machine or display. Some examples of the potential scope include foot control of a sewing machine, vehicle (accelerator), stage lighting, test instrument, powered production tools such as welders, bonders, drills and presses, and so forth.

The transducer of this invention is also readily adapted to function as a simple switch rather than as a variable resistance, since it goes to an open circuit with no pressure applied. Electronic relay switching circuitry capable of being controlled from a relatively high "on" resistance values are well known in the electronics field.

It can also serve as a "soft" switch for certain applications where a momentary higher resistance is desired upon initial closing rather than the abrupt transition of ordinary conductive switch contacts.

The transducer of this invention as realized in a preferred embodiment may be readily constructed from available materials. The rigid base plate 10 is made of Masonite. The semi-rigid sensor plate 14 is made from Formica, approximately 2" by 2" by 0.04" thick. The resistive element 22 is cut from two inch wide Mylar audio tape of the type commonly used in the audio recording industry; the tape is typically 2.5 mils thick, having as a black matte surface on one side a resistive carbon coating about 0.04 mils thick, typically measuring in the order of 20,000 ohms across two points spaced 1 centimeter apart. The opposite side, which is non-conductive and has a smooth brown shiny surface, is placed upwardly and attached to the the lower side of sensor plate 14 by means of the 0.05" double-sided adhesive foam plastic layer 20, which serves as a resilient spacer.

Contact plates 26 and 28 are made of 0.05" thick aluminum, and attached to conductors of cable 18 by brass eyelets at junctions 30 and 32 (FIGS. 2 and 3). In cable 18, one of the conductors may be the outer grounded sheath of a shielded coaxial cable, however since the resistive transducer terminals are typically operating in a "d.c. control voltage" mode, cable shielding is not critical, especially if the terminals are capacitively bypassed.

The looped member of the Velcro gasket is typically 0.1" thick, the hooked member 0.08"; the total combined thickness, 0.140" typical, establishes the spacing between the base plate 10 and the sensor plate 14. The internal buildup (0.05" contact plates, 0.05" foam layer, and 0.0025" resistive element) totals 0.1025"; thus, in the absence of applied pressure, the resistive element 22 is nominally spaced 0.0375" from the contact plates 26 and 28.

A typical resistance range realized is 5,000 to 200,000 ohms, and the shape of the cutaway boundary 24 shown in FIGS. 2 and 4 for element 22 provided a taper suitable for voltage controlled audio volume control of a musical instrument amplifier. The overall transfer characteristic depends on the shape of the cutaway boundary 24 of element 22 in conjunction with the voltage control characteristic of the electronic circuitry, which may be modified by those of skill in the electronic arts. Typically, the ability provided by this invention to "trim" to a desired overall response by shaping the cutaway sector boundary 24 avoids having to alter a standardized response already established in the electronic equipment.

The easy access for modification and the ease of replacing of resistive element 22 and/or layer 20 enable a musician or other operator to tailor the response to special requirements: a musical instrument setup may utilize several separate different transducer units, each tailored to the particular attribute or parameter controlled, such as volume, tone, delay, echo and the like.

There are numerous alternatives to the preferred embodiment as shown and described which may be vaiable in implementing the invention; for example, the base plate 10 may be made from any suitable rigid material such as plastic, plywood or metal; however the use of conductive material such as metal would require plates 26 and 28 to be insulated from the base plate 10 by a layer of suitable insulation material such as a plastic tape, which could be secured by double sided adhesive. Pedal plate 14 could be of alternative semi-rigid material. Plates 26 and 28 could be of another metal instead of alumium, however these do not necessarily require the high conductivity of metal, and therefore could be made of alternative conductive material such as metallized or carbon fiber filled plastic, or an equivalent conductive flexible or resilient material. The junctions 30 and 32 may be formed from rivets and/or may be soldered, as an alternative to eyelets.

The combination of flexible sensor plate 14 (FIG. 2), foam layer 20 and gasket members 12 and 16 may be considered functionally as a resilient cover cap assembly 13 serving externally as a foot sensor and internally as the mounting for supporting the resistive element 22 close to the contact plates 26 and 28, with sufficient resilience to enable the element to be pressed downwardly into contact with the contact plates; this function could be implemented in an alternative configuration such as a one piece resilient cover cap, which could be molded from a suitable resilient plastic material. The Velcro type removable fastening system could be provided alternatively by side flanges secured to the base plate 10 with screw fastenings.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A pressure-to-conductance transducer comprising:

a rigid base plate providing a flat non-conductive surface;

a pair of adjacent coplanar conductive contact plates, separated by an elongated gap and affixed to the surface of said base plate;

a cover cap having a planar sensor portion, and having a sidewall portion disposed in a peripheral region surrounding said pair of contact plates and secured to said base plate, the sensor portion, being disposed in a plane parallel with that of the base plate surface, having an outward surface adapted to receive pressure applied by an operator, and an opposed inward surface facing said contact plates;

a resistive element having a surface affixed to the inward surface of the sensor portion of said cover cap and having an opposed inwardly-facing resistively coated surface;

compliant means, associated with said cover cap, enabling varying pressure, applied by an operator to the outward surface of said cover cap sensor portion, to vary an area of contact between said resistive element coating and said contact plates, and to thus manifest a corresponding variable conductance value between said contact plates.

2. The transducer as defined in claim 1 wherein said resistive element coating is disposed closely spaced from said contact plates such that in the absence of pressure applied to the sensor portion of said cover cap, an open circuit is manifested between said contact plates.

3. The transducer as defined in claim 1 wherein said resistive element is made to have an outline shape such that a resistive current path therein between said contact plates tends to increase in effective width and decrease in effective length with increasing pressure applied to the sensor portion of said cover cap, whereby variations in the applied pressure are caused to be transduced into corresponding variations in the conductance value.

4. The transducer as defined in claim 1 wherein said compliant means comprises a flexible pressure plate, forming the sensor portion of said cover cap, affixed to the sidewall portion.

5. The transducer as defined in claim 1 wherein said compliant means comprises a compliant spacer gasket, forming the sidewall portion of said sensor cap, affixed to said sensor portion.

6. The transducer as defined in claim 5 wherein said compliant spacer gasket comprises a mating pair of layers secured together at an interface by a separable gripping system of the hook and loop type.

7. A pressure-to-conductance transducer comprising:

a rigid base plate providing a flat non-conductive surface;

a pair of adjacent coplanar conductive contact plates, separated by an elongated gap and affixed to the surface of said base plate;

a cover cap having a planar sensor portion, and having a sidewall portion disposed in a peripheral region surrounding said pair of contact plates and secured to said base plate, the sensor portion, being disposed in a plane parallel with that of the base plate surface, having an outward surface adapted to receive pressure applied by an operator, and an opposed inward surface facing said contact plates;

a resistive element having a surface affixed to the inward surface of the sensor portion of said cover cap and having an opposed inwardly-facing resistively coated surface, said resistive element being made to have an outline shape approximating that of said pair of contact plates in combined outline, said element having a cutaway sector extending to a perimeter edge of said element and located so as to span a portion of the gap between said contact plates; and complaint means, associated with said cover cap, whereby varying pressure, applied by an operator against said cover cap sensor portion acts to press said resistive coating against said contact plates over a variable area ranging from (a) a minor area bridging a portion of the cutaway region such as to configure a relatively long, narrow effective current path through the resistive coating, thus manifesting a relatively low conductance value between said contact plates in response to weak pressure applied to said cover cap sensor portion, at an edge thereof in the vicinity of the cutaway sector, to (b) a major area of said element resistive coating so as to configure a relatively short, wide effective current path, thus manifesting a relatively high conductance value between said contact plates in response to strong pressure applied generally to said cover cap sensor portion.

8. The transducer as defined in claim 7 wherein the cutaway sector of said resistive element is shaped generally as a triangle of which one side is coincident with a perimeter edge of said element and thus the cutaway sector has two boundary edges corresponding to two sides of the triangle disposed within a general outline of said element.

9. The transducer as defined in claim 8 wherein the two boundary edges of the cutaway sector of said resistive element are curvilinearly shaped in a manner to provide a desired pressure-to-conductance transfer characteristic response.

10. The transducer as defined in claim 1 wherein said base plate, said cover cap sensor portion and said resistive element are made to have a substantially square outline, and said contact plates are made rectangular, each approximating half of the square outline, the sidewall portion forming a gasket having a substantially square frame shape surrounding the contact plates and the resistive element.

11. The transducer as defined in claim 10, adapted for operation from foot pressure with said base plate disposed horizontally on a floor surface, the transducer further comprising:

an electric cable, including a pair of conductors, one connected to each of said contact plates, routed through said sidewall portion, adapted to enable the transducer to be electrically connected to electronic equipment to be controlled from the transducer.

12. The transducer as defined in claim 1 further wherein said resistive element is affixed to the inside surface of said cover cap sensor portion by a double-sided-adhesive-coated layer of resilient foam plastic material interposed between said element and said cover cap sensor portion.

13. An improved pressure-to-conductance transducer, responsive to foot pressure, for providing a control input to an electronic circuit such as a voltage-controlled musical processing device, the transducer comprising:

a rigid base plate, adapted for normal disposition on a floor surface, providing an upwardly facing flat non-conductive horizontal surface, a pair of adjacent coplanar conductive contact plates, separated by an elongated gap and affixed to the surface of said base plate;

a cover cap having a horizontal sensor portion, and having a sidewall portion disposed in a peripheral region surrounding said pair of contact plates and secured to said base plate, the sensor portion having an upward surface adapted to receive pressure applied by an operator, and an opposed downward surface facing said contact plates;

a resistive element configured as a sheet having a surface affixed to the downward surface of the sensor portion of said sensor cap and an opposed downwardly facing resistively coated surface disposed closely spaced from said contact plates such that in the absence of pressure applied to said sensor portion, an open circuit is manifested between said contact plates;

said cover cap being provided with complaint means enabling pressure applied by an operator to the sensor portion to impress an area of contact between said resistive element coating and said contact plates, thus forming in said resistive coating a current path of finite conductance value between said contact plates, the conductance value being inversely proportional to an aspect ratio defined as mean effective length of the current path divided by mean effective width of the current path between said contact plates;

said resistive element being shaped to have a void area such that the aspect ratio of said current path tends to decrease with increasing pressure, whereby variations in the applied pressure are caused to be transduced into corresponding variations in the conductance value.

14. The transducer as defined in claim 13 wherein said compliant means comprises a semi-rigid flexible pressure plate, forming the sensor portion of said cover cap, affixed to said sidewall portion, said resistive element being affixed to the downward surface of said pressure plate by a double-sided-adhesive-coated layer of resilient foam plastic material interposed between said element and said pressure plate.

15. The transducer as defined in claim 14 wherein said complaint means comprises a complaint spacer gasket, forming the sidewall portion of said cover cap, affixed to said cover cap sensor portion.

16. The transducer as defined in claim 15 wherein said spacer gasket comprises a pair of layers matedly joined at an interface by a separable gripping system of the hook and loop type.

17. The transducer as defined in claim 13 wherein said resistive element is made to have an outline shape approximating that of the downward surface of said cover cap but having a cutaway sector extending to a perimeter edge of said element and located so as to span a portion of the gap between said contact plates;

whereby variable pressure applied to said pressure plate acts to press said element against said contact plates over a variable area ranging from (a) a minor area bridging a portion of the cutaway region so as to manifest a relatively low effective width-divided-by-length ratio in the current path, thus manifesting a relatively low conductivity value between said contact plates in response to weak pressure applied to the pressure plate at an edge region thereof in the vicinity of the cutaway sector, to (b) a major area of the element so as to manifest a relatively high effective width-divided-by-length ratio in the current path, thus manifesting a relatively high conductance value between said contact plates in response to strong pressure applied generally to the pressure plate.

18. The transducer as defined in claim 17 wherein the cutaway sector of said resistive element is made to a have a generally triangular shape extending to a perimeter edge of said element, the shape being configured in a manner to provide a desired pressure-to-conductance transfer response.

19. The transducer as defined in claim 13 wherein said base plate, said sensor plate, said cover cap and said resistive element are made to have a generally square outline, and said contact plates are made rectangular, each approximating half of the square outline, the sidewall portion forming a gasket having square frame shape surrounding the contact plates and the resistive element.

20. The transducer as defined in claim 13 further comprising an electric cable, including a pair of conductors, one connected to each of said contact plates, routed through said sidewall portion, adapted to enable the transducer to be electrically connected to electronic equipment to be controlled from the transducer.

* * * * *